US008740754B2

(12) United States Patent
Miller

(10) Patent No.: US 8,740,754 B2
(45) Date of Patent: Jun. 3, 2014

(54) ADAPTIVE EXERCISE DEVICE

(76) Inventor: Larry D. Miller, Rochester, MI (US)

( * ) Notice: Subject to any disclaimer, the term of this patent is extended or adjusted under 35 U.S.C. 154(b) by 553 days.

(21) Appl. No.: 12/987,223

(22) Filed: Jan. 10, 2011

(65) Prior Publication Data

US 2011/0172062 A1 Jul. 14, 2011

Related U.S. Application Data

(60) Provisional application No. 61/293,807, filed on Jan. 11, 2010.

(51) Int. Cl.
*A63B 22/00* (2006.01)
*A63B 22/04* (2006.01)

(52) U.S. Cl.
USPC ..... 482/52; 482/51

(58) Field of Classification Search
USPC ..... 482/52–53, 57–62, 79–80, 51
See application file for complete search history.

(56) References Cited

U.S. PATENT DOCUMENTS

| | | | | |
|---|---|---|---|---|
| 5,226,109 | A * | 7/1993 | Dawson et al. | 345/420 |
| 5,383,829 | A * | 1/1995 | Miller | 482/57 |
| 5,788,610 | A * | 8/1998 | Eschenbach | 482/52 |
| 5,919,118 | A * | 7/1999 | Stearns et al. | 482/51 |
| 6,024,676 | A * | 2/2000 | Eschenbach | 482/51 |
| 6,152,859 | A * | 11/2000 | Stearns | 482/52 |
| 6,196,948 | B1 * | 3/2001 | Stearns et al. | 482/52 |
| 6,277,054 | B1 * | 8/2001 | Kuo | 482/51 |
| 6,361,476 | B1 * | 3/2002 | Eschenbach | 482/52 |
| 6,390,953 | B1 * | 5/2002 | Maresh et al. | 482/52 |
| 6,422,977 | B1 * | 7/2002 | Eschenbach | 482/52 |
| 6,440,042 | B2 * | 8/2002 | Eschenbach | 482/52 |
| 6,461,277 | B2 * | 10/2002 | Maresh et al. | 482/52 |
| 6,612,969 | B2 * | 9/2003 | Eschenbach | 482/51 |
| 6,726,600 | B2 * | 4/2004 | Miller | 482/51 |
| 6,840,892 | B1 * | 1/2005 | Wu | 482/51 |
| 6,875,160 | B2 * | 4/2005 | Watterson et al. | 482/57 |
| 7,104,929 | B1 * | 9/2006 | Eschenbach | 482/52 |
| 7,121,984 | B1 * | 10/2006 | Hong | 482/52 |
| 7,132,531 | B1 * | 11/2006 | Wellings et al. | 536/25.3 |
| 7,169,088 | B2 * | 1/2007 | Rodgers, Jr. | 482/52 |
| 7,169,089 | B2 * | 1/2007 | Rodgers, Jr. | 482/52 |
| 7,172,531 | B2 * | 2/2007 | Rodgers, Jr. | 482/52 |
| 7,179,201 | B2 * | 2/2007 | Rodgers, Jr. | 482/52 |
| 7,201,705 | B2 * | 4/2007 | Rodgers, Jr. | 482/52 |
| 7,214,168 | B2 * | 5/2007 | Rodgers, Jr. | 482/52 |
| 7,226,392 | B2 * | 6/2007 | Hong | 482/52 |
| 7,244,217 | B2 * | 7/2007 | Rodgers, Jr. | 482/52 |
| 7,244,218 | B1 * | 7/2007 | Lin et al. | 482/52 |

(Continued)

*Primary Examiner* — Stephen Crow
(74) *Attorney, Agent, or Firm* — Terence P. O'Brien; Todd A. Rathe; Ronald W. Otkowski

(57) ABSTRACT

An adaptive exercise device provides for a foot motion in which the vertical component of the path of foot travel is mechanically decoupled from the fore-aft component of the path of foot travel so that a user may selectably control the ratio of these two components during the use of the device. The adaptive exercise device includes foot links which are supported on a track for motion therealong. The links are mechanically interconnected so that when a first link moves in a first direction along the track, the second link moves in an equal and opposite direction. The apparatus further includes a vertical motion control system which raises and lowers portions of each of the foot links along a vertical path of travel independent of their position along the track.

22 Claims, 8 Drawing Sheets

(56) References Cited

U.S. PATENT DOCUMENTS

| | | | | |
|---|---|---|---|---|
| 7,316,632 | B2 * | 1/2008 | Rodgers, Jr. | 482/52 |
| 7,377,881 | B2 * | 5/2008 | Moon | 482/52 |
| 7,485,072 | B2 * | 2/2009 | Chuang et al. | 482/52 |
| 7,507,184 | B2 * | 3/2009 | Rodgers, Jr. | 482/52 |
| 7,520,839 | B2 * | 4/2009 | Rodgers, Jr. | 482/52 |
| 7,530,926 | B2 * | 5/2009 | Rodgers, Jr. | 482/52 |
| 7,556,591 | B2 * | 7/2009 | Chuang et al. | 482/52 |
| 7,604,573 | B2 * | 10/2009 | Dalebout et al. | 482/52 |
| 7,632,219 | B2 * | 12/2009 | Ohrt et al. | 482/52 |
| 7,641,598 | B2 * | 1/2010 | Rodgers, Jr. | 482/52 |
| 7,678,025 | B2 * | 3/2010 | Rodgers, Jr. | 482/52 |
| 7,708,668 | B2 * | 5/2010 | Rodgers, Jr. | 482/51 |
| 7,708,669 | B2 * | 5/2010 | Rodgers, Jr. | 482/52 |
| 7,717,828 | B2 * | 5/2010 | Simonson et al. | 482/52 |
| 7,794,362 | B2 * | 9/2010 | Miller | 482/52 |
| 7,811,208 | B2 * | 10/2010 | Rodgers, Jr. | 482/52 |
| 7,828,698 | B2 * | 11/2010 | Rodgers, Jr. | 482/52 |
| 7,874,963 | B2 * | 1/2011 | Grind | 482/71 |
| 7,887,465 | B2 * | 2/2011 | Uffelman | 482/52 |
| 7,922,625 | B2 * | 4/2011 | Grind | 482/52 |
| 2004/0224825 | A1 * | 11/2004 | Giannelli et al. | 482/52 |
| 2004/0248709 | A1 | 12/2004 | Rodgers, Jr. | 482/83 |
| 2007/0087906 | A1 * | 4/2007 | Rodgers, Jr. | 482/52 |
| 2007/0087907 | A1 * | 4/2007 | Rodgers, Jr. | 482/52 |
| 2007/0232457 | A1 * | 10/2007 | Porth | 482/51 |
| 2008/0064572 | A1 * | 3/2008 | Nardone | 482/52 |
| 2009/0156369 | A1 | 6/2009 | Rodgers, Jr. | 482/52 |
| 2010/0167878 | A1 | 7/2010 | Grind | 482/52 |
| 2012/0238408 | A1 * | 9/2012 | Miller | 482/52 |

* cited by examiner

ADAPTIVE EXERCISE DEVICE

CROSS-REFERENCE TO RELATED APPLICATIONS

This application claims priority of U.S. Provisional Patent Application Ser. No. 61/293,807 filed Jan. 11, 2010, and entitled "Adaptive Exercise Device", the disclosure of which is incorporated herein by reference.

BACKGROUND

Elliptical exercise devices provide a very natural, elliptical, path of travel for a user's foot which simulates walking and running motions. Hence these devices are in widespread use. The elliptical path of travel includes a horizontal component of foot motion and a vertical component. As will be explained hereinbelow, the present invention provides an improved exercise device which incorporates a unique mechanism that allows the user to effectively decouple the horizontal and vertical components of the path of foot motion. Furthermore, this decoupling may be accomplished "on the fly" so that a user can vary stride length and other such parameters while exercising. The present invention includes two separate mechanisms for controlling foot motion. One mechanism controls the horizontal component of foot motion, and the second mechanism independently controls the vertical component of foot motion. Each motion can be used by itself or the two modes of motion may be combined to establish various elliptical paths of foot travel.

The system of the present invention may be implemented in a variety of configurations. Certain specific configurations are disclosed herein, and yet other configurations will be apparent to those of skill in the art in view of the present teaching.

SUMMARY

Disclosed is an adaptive exercise device which includes a frame configured to be supported on a floor. At least one track is supported on the frame, and this track may be a straight or a curved track. The device further includes a first and a second foot link. At least one roller is associated with each of the foot links and is disposed so as to engage the track and to support its respective foot link thereupon. A linkage system is associated with each of the foot links, and the linkage system is operative to control the motion of the foot links so that when the first foot link moves in a first direction along the at least one track, the second foot link moves in an equal and opposite direction. The device includes a first and a second vertical control link each having a first portion connected to the first portion of a respective foot link. The device also includes a first and a second vertical control lever each of which is pivotally supported on the frame at a first pivot point. Each vertical control lever is pivotally attached to a second portion of a respective one of the first and second vertical control links. The device further includes a rotary crank which comprises at least one crank arm. The crank is pivotally supported on the frame at a second pivot point, and a first and a second connector link each have a respective first portion pivotally attached to the crank and a second portion which is pivotally attached to a respective one of the first and second vertical control levers so that when the crank rotates about the second pivot point, the first and second vertical control levers each move back and forth in a reciprocating motion which is in turn communicated to a respective one of the first and second foot links via the vertical control links.

In some embodiments, the device may include a first and a second arm extension each of which is pivotally connected to the frame at a third pivot point and is also mechanically coupled to a respective one of the first and second foot links so that when the foot links move along said at least one track, the arm extensions pivot about the third pivot point.

The track may be a curved member, and in particular instances may be curved so as to define a true arc comprising a segment of a circle wherein the center of said circle defines a virtual pivot point. In particular instances, at least one of the first, second, or third pivot points may coincide with another one of said pivot points or with a virtual pivot point.

The device may optionally include a variable resistance device, such as a flywheel, disposed in mechanical communication with various of the moving components of the device. In this manner, the variable resistance device may be adjusted to vary the amount of effort associated with moving the foot links in their vertical path of travel and/or along the tracks. Likewise, the variable resistance device may be operative to engage the arm extensions.

DETAILED DESCRIPTION OF PREFERRED EMBODIMENTS

Figure 1:
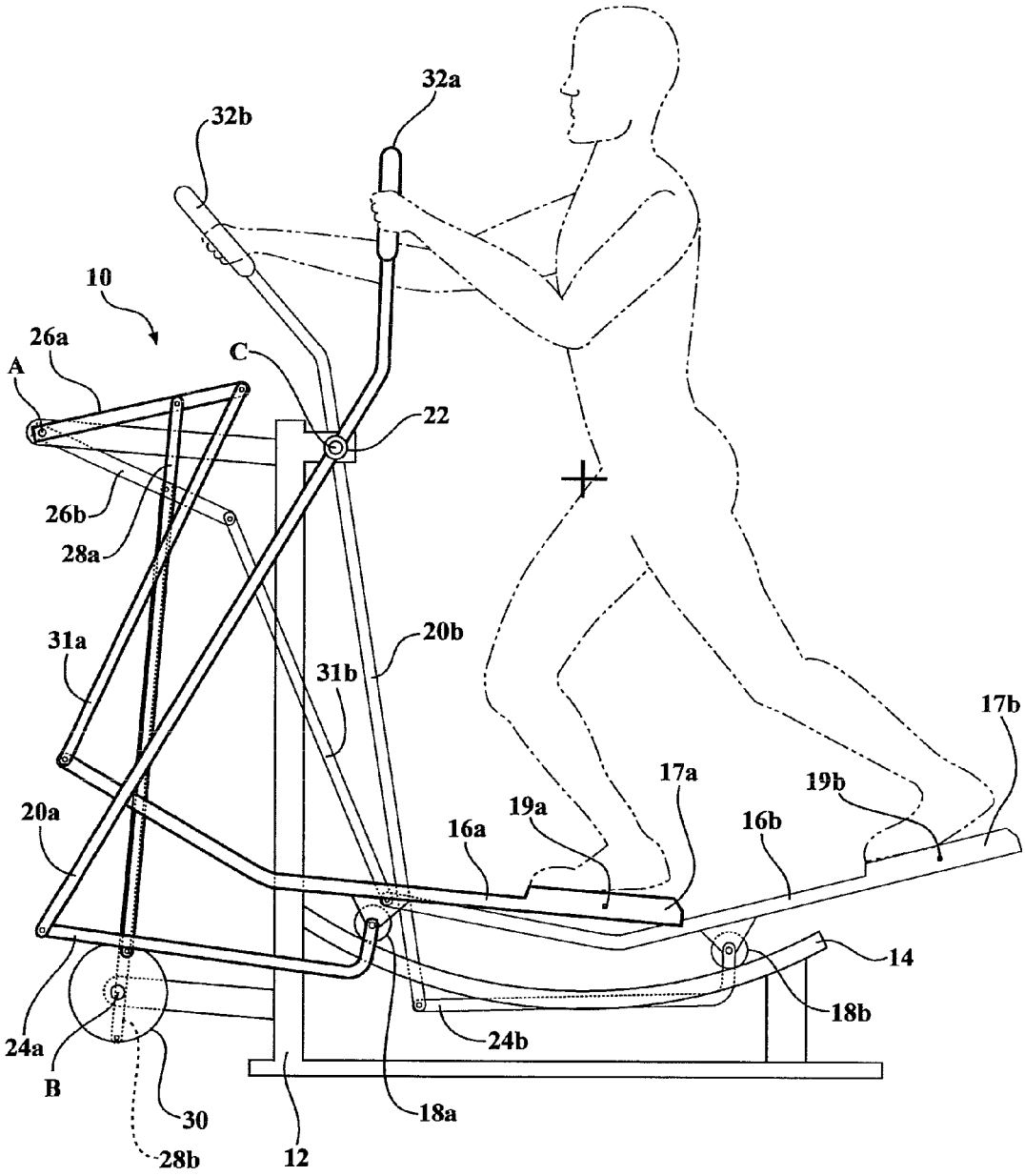
FIG. 1 is a schematic depiction of one embodiment of exercise device structured in accord with the principles of the present invention.
Figure 2:
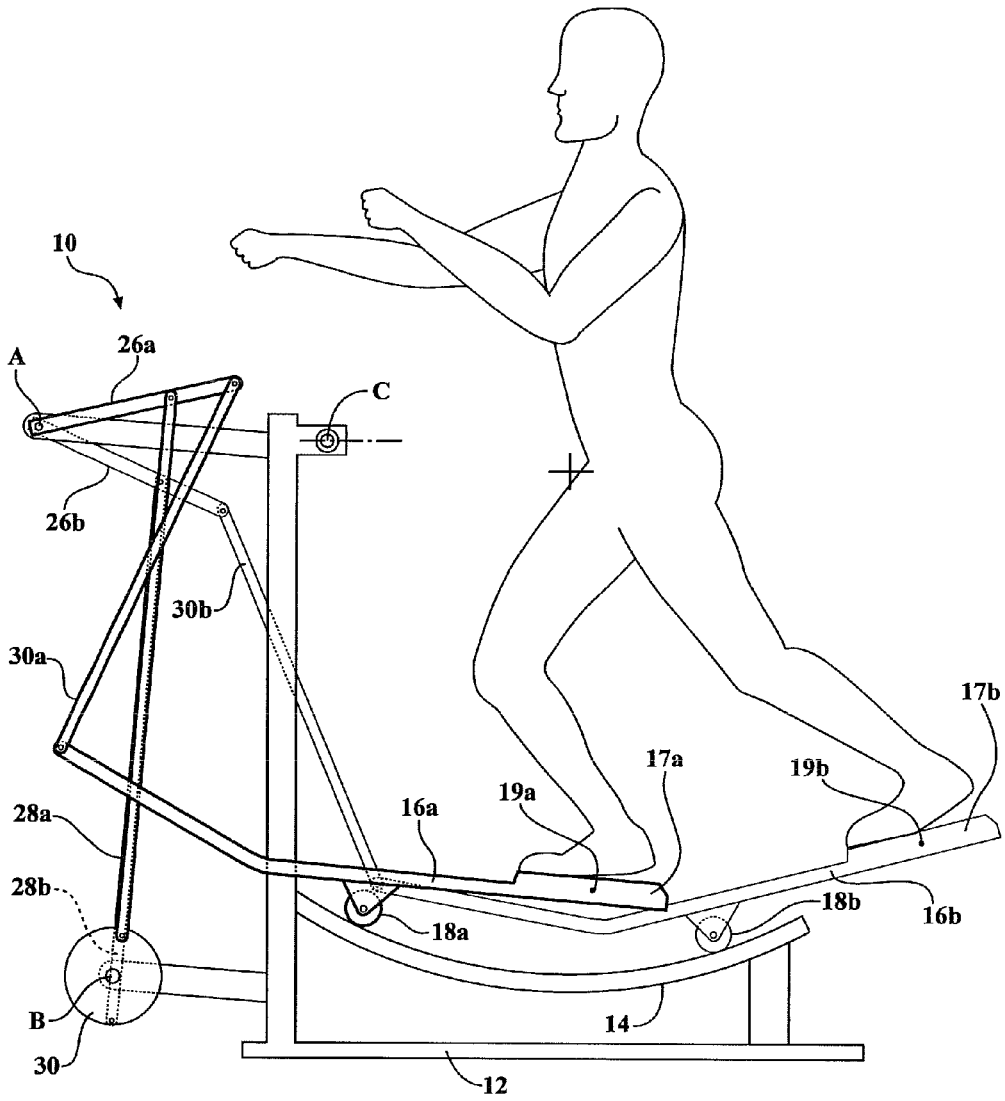
FIG. 2 is a depiction of a portion of the FIG. 1 device specifically showing the mechanism for controlling the horizontal component of the foot motion.
Figure 3:
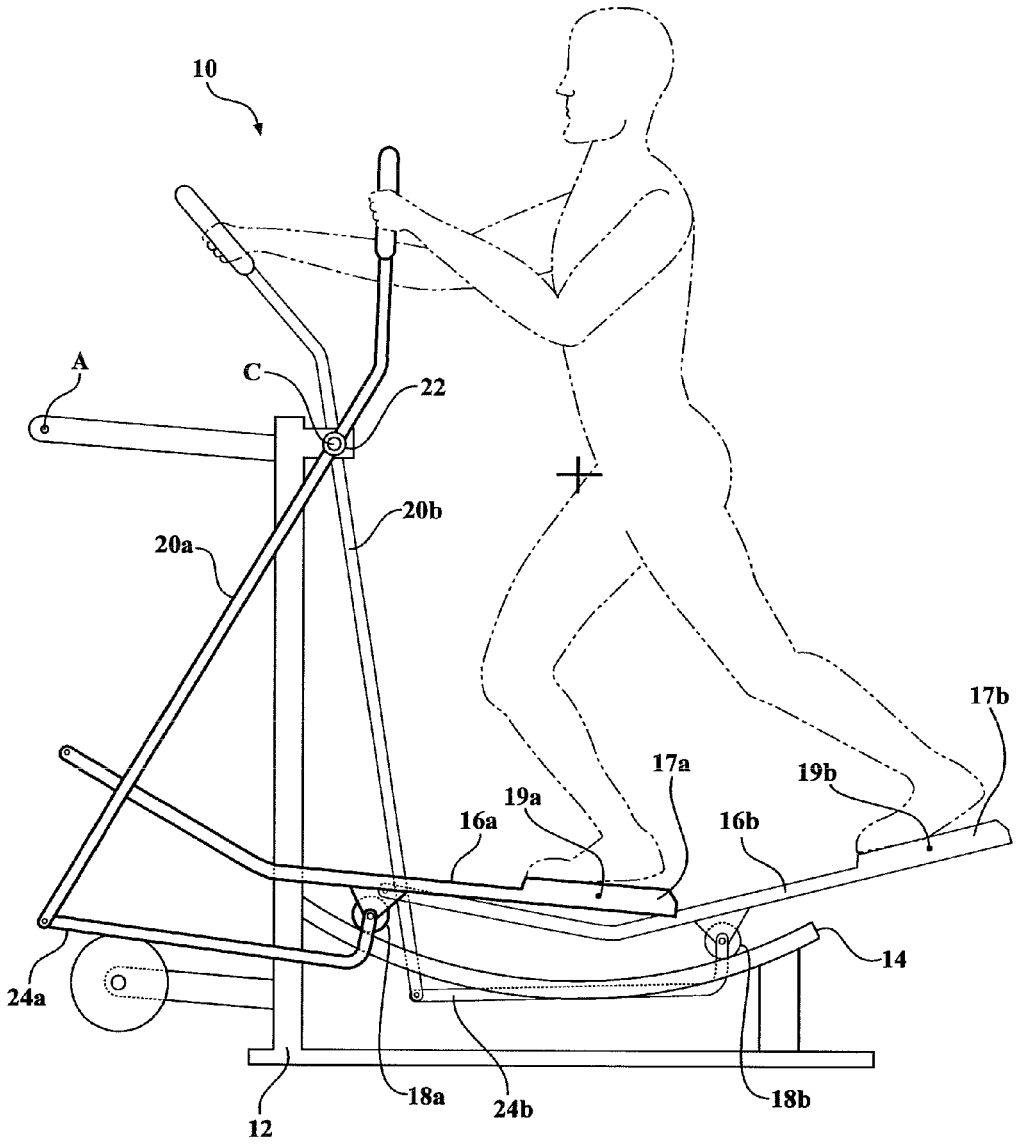
FIG. 3 is a schematic depiction of a portion of the exercise device of FIG. 1 specifically showing the mechanism for controlling the vertical component of foot motion.

The present invention is directed to an adaptive exercise device which provides a user with a natural, elliptical path of travel. In accord with the present invention, the vertical and horizontal components of foot motion defining the elliptical path of travel are mechanically decoupled so as to allow for the user to vary the stride length and other parameters on a continuous basis while exercising. FIGS. 1-3 depict one particular embodiment of such an exercise device. In this regard, FIG. 1 is an overall schematic depiction of this embodiment of exercise device, while FIG. 2 shows a schematic depiction of the mechanical components of the FIG. 1 device as operative to provide control of the vertical component of the foot motion, and FIG. 3 is a schematic depiction of the mechanical components which allow for control of the horizontal component of the foot motion.

Referring now to FIG. 1, there is shown an adaptive exercise device 10. The device 10 includes a frame 12 which is configured to be supported on a floor or other such support surface. Although not shown, the frame 12 can include wheels, skid pads, legs, and other such ancillary features. A track 14 is supported on the frame. As will be explained in detail hereinbelow, the track 14 serves to support and guide various, other components of the device. As shown in FIG. 1, the track 14 is a single member; however, in other instances the track function may be accomplished by a plurality of discrete track members. Hence, the apparatus is described as including at least one track. As shown in FIG. 1, the track 14 is curved; in particular, the track 14 of FIG. 1 is curved so as to form an arc of a perfect circle, and this circle has a center point which defines a virtual pivot point X of the device which in this instance is disposed at approximately waist level of a person using the device. In other embodiments, the track 14 may be straight or otherwise curved. Also, it is to be understood that the position, and/or shape, of the track 14 may be made to be adjustable.

The apparatus 10 of FIG. 1 includes a first foot link 16*a* and a second foot link 16*b* (collectively referred to as foot links 16). Foot links 16 include foot supports or pads 17*a* and 17*b* (collectively referred to as foot pads 17). Foot pads 17*a*, 17*b* have centers 19*a*, 19*b*, respectively, and are configured to support a user's foot thereupon. Foot pads 17 may have various other shapes and configurations and may include additional features such as straps. Each of the foot links 16 is supported on the track 14 by a respective roller 18*a*, 18*b*. As shown in the figure, a single roller 18 is used to support each foot link 16; however, it is to be understood that multiple roller configurations may also be employed similarly. In another embodiment, foot links 16 may alternatively be movably supported along tracks 14 in other manners. For example, in some embodiments, foot links 16 may be directly or indirectly pivotably coupled or pivotably connected to a slider that slides along track 14 and is directly or indirectly pivotably coupled to or connected to a link 24 coupled to a swing arm 20. The device 10 further includes a linkage system associated with each of said first and second foot links. The linkage system operates to control the motion of the foot links 16*a*, 16*b* along the track 14 so that when the first foot link moves in a first direction along the track, the second foot link moves in an equal and opposite direction along the track. In the FIG. 1 embodiment, this linkage system includes a first and a second swing arm 20*a*, 20*b* which are pivotally supported on the frame 12 by a mechanical coupling 22 which operates to synchronize the motion of the swing arms 20*a*, 20*b* so that when one arm moves forward, the other arm will move rearward in a corresponding amount. It will be noted that this mechanical coupling 22 in, in this particular embodiment located on the frame 12, so as to be coincident with a third pivot point C which is associated with optional arm links, as will be described in detail in hereinbelow. However, the present invention does not require that the mechanical coupling 22, or any corresponding element be located at the third pivot point.

Various mechanical gearing arrangements may be employed to accomplish the function of synchronizing the motion of the swing arms, and some such arrangements are shown in U.S. Pat. No. 7,794,362, the disclosure of which is incorporated herein by reference. The linkage system further includes, in this embodiment, L-shaped couplers 24*a*, 24*b* which join the rollers 18 of the respective foot links 16 to the respective swing arms 20.

Referring now to FIG. 3, there is shown a partial depiction of the apparatus 10 of FIG. 1 illustrating the portions of the apparatus which provide for the fore and aft motion of the foot links 16. As will be seen, the motion of one of the foot links along the track 14 will cause the other of the foot links to move in an equal and opposite direction along the track, owing to the action of the mechanical coupling 22. Thus, a user of the device selectably controls the fore and aft motion of the foot links while keeping those motions in synchrony, thereby selectably controlling the range of fore-aft motion. It is to be understood that owing to the configuration of the track 14 and/or the configuration of the foot links 16 and/or the nature of the linkage system, the fore-aft motion of the user's foot may not always be strictly linear and may comprise a somewhat curved motion or a more complex motion. However, the feature of the present invention is that the horizontal component of the motion (which controls stride length and which is the dominant component of the fore-aft motion) may be controlled in synchrony, while the device is being used.

Referring back to FIG. 1, it will be seen that the device 10 further includes a system for controlling the vertical component of foot motion and in this regard includes a first and a second vertical control lever 26*a* and 26*b* which are pivotally supported on the frame 12 at a first pivot point A. The vertical control system further includes a first and a second connector link 28*a*, 28*b*. Each connector link 28 is connected to a respective vertical control lever 26. It will be noted that in the FIG. 1 illustration, the connector link 28*b* is primarily disposed behind the connector link 28*a* and hence is shown in phantom outline. The connector links 28 are coupled to a rotary crank assembly 30 which is pivotally supported on the frame 12 at a second pivot point B. The crank assembly may be variously configured but includes at least one crank arm which, when the crank assembly rotates, operates to reciprocate the connector links 28*a* and hence move their associated vertical control levers 26 about the first pivot point A. As shown in the FIG. 1 embodiment, the crank 30 comprises a disc, and the crank arm portions thereof are defined by portions of the disc extending from the second pivot point B to the circumference of the disc. In other instances, the crank assembly may include one or more discrete crank arms.

The vertical motion control system further includes a first and a second vertical control link 31*a*, 31*b* disposed so as to pivotally couple a respective vertical control lever 26 to its respective foot link 16. As will be seen, the vertical control links in FIG. 1 are directly coupled to ends of the foot links; however, coupling may be accomplished at other connection points with regard to these elements. It is to be understood that the various connection points may be made adjustable so as to vary the configuration of the device and the presence of projecting portions of the various links and the levers, beyond their connection points, will not affect the function of the device. Therefore, when connections are described as being made at the "end" of a member, it is to be understood that such ends are defined by the points of connection and that projecting portions may extend therefrom.

Referring now to FIG. 2, the vertical motion control system is shown in isolation from the remainder of the apparatus 10. As will be seen from FIG. 2, rotation of the crank 30 will cause the connector links 28*a*, 28*b* to move along a vertical path of travel thereby pivoting the vertical control levers 28*a*, 28*b* about the first pivot point A. This motion causes the associated vertical control links 31*a*, 31*b* to likewise move along a path of travel having a large vertical component and thereby pivot the associated foot links 16*a*, 16*b* about their support points as defined by the associated rollers 18*a* and 18*b*. This motion will correspondingly raise and lower the opposite end of the associated foot link so as to raise and lower a user's foot. It will be seen from FIG. 2 that this motion will be independent of any fore-aft motion of the foot link 16*a*, 16*b* along the track 14.

It should be understood that while the first, second and third pivot points are shown as being at particular locations on the frame, they may be otherwise disposed. In particular embodiments, the various pivot points may coincide. For example, in the embodiment of FIGS. 1-3, the first pivot point A and the third pivot point C may coincide. In this regard. The vertical control levers 26*a* and 26*b* may be supported at the third pivot point C so as to project forward of the user. Still other configurations may be implemented.

Figure 5:
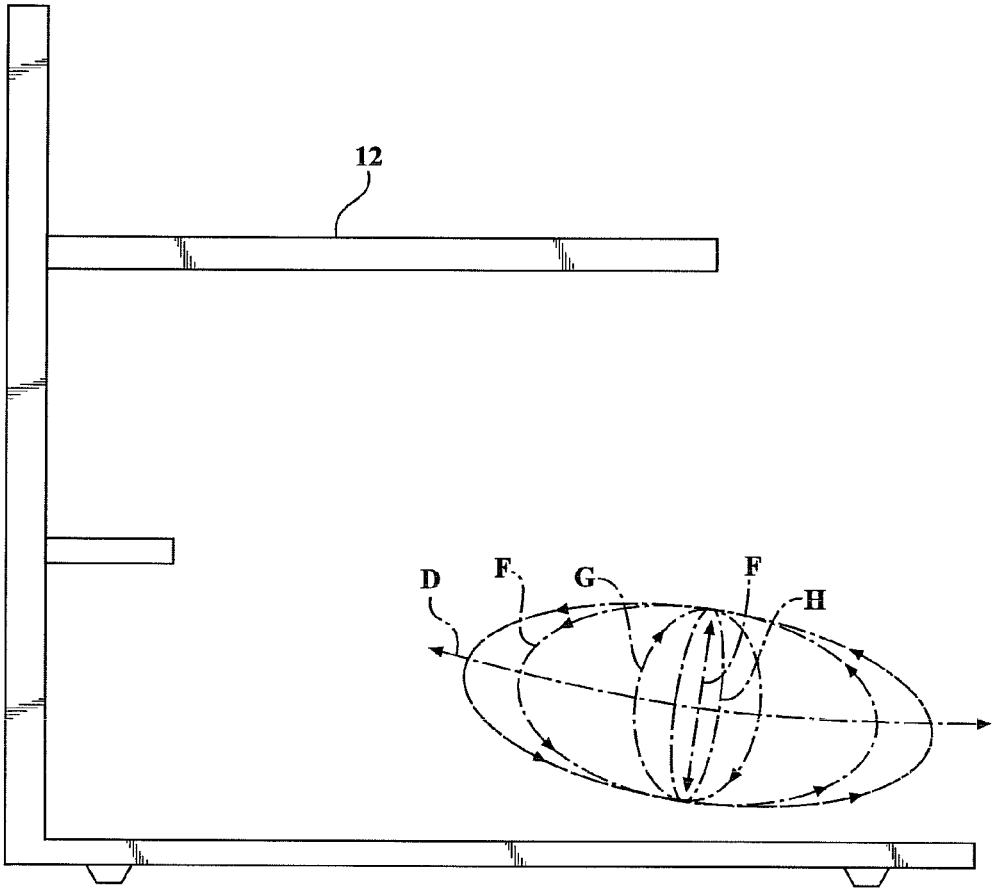
FIG. 5 illustrates various paths of foot travel which may be achieved through the use of the present invention.

Thus, by reference to FIGS. 1-3 it will be seen that the present apparatus effectively decouples the vertical component of the foot motion from the fore-aft component of the foot motion thereby allowing a user to continuously vary the relative ratio of fore-aft to vertical motion during the use of the device, so as to adapt the foot motion to the user's needs. Referring now to FIG. 5, there is shown a schematic depiction of possible paths of foot travel relative to a frame 12 of an exercise device generally similar to that described herein. As shown therein, a user may choose a first path of foot travel D which is a solely fore-aft path of travel utilizing only the mechanical components illustrated in FIG. 3. Likewise, the user may employ a path of foot travel E solely employing the vertical control system component illustrated in FIG. 2. Also, the user may blend motions of the two control systems to achieve various elliptical paths of travel F, G, H. Furthermore, the user may continuously move between these various paths of travel during the operation of the device thereby providing for a diverse workout.

Figure 6:
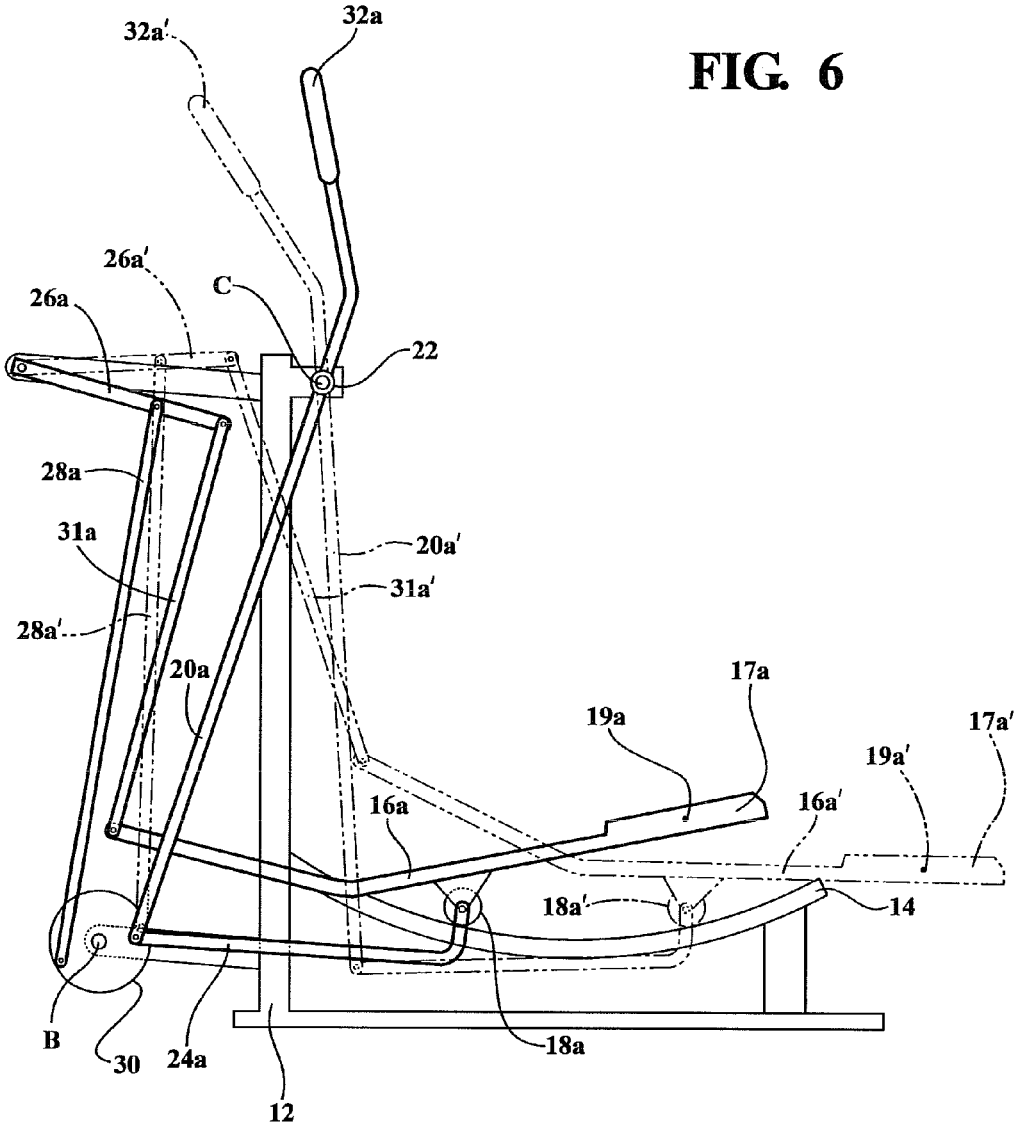
FIG. 6 is a side elevational view of the exercise device of FIG. 1 illustrating a single foot pad center point in a first position having a first horizontal location and a first vertical location and a second position having a second horizontal location and a second vertical position.
Figure 7:
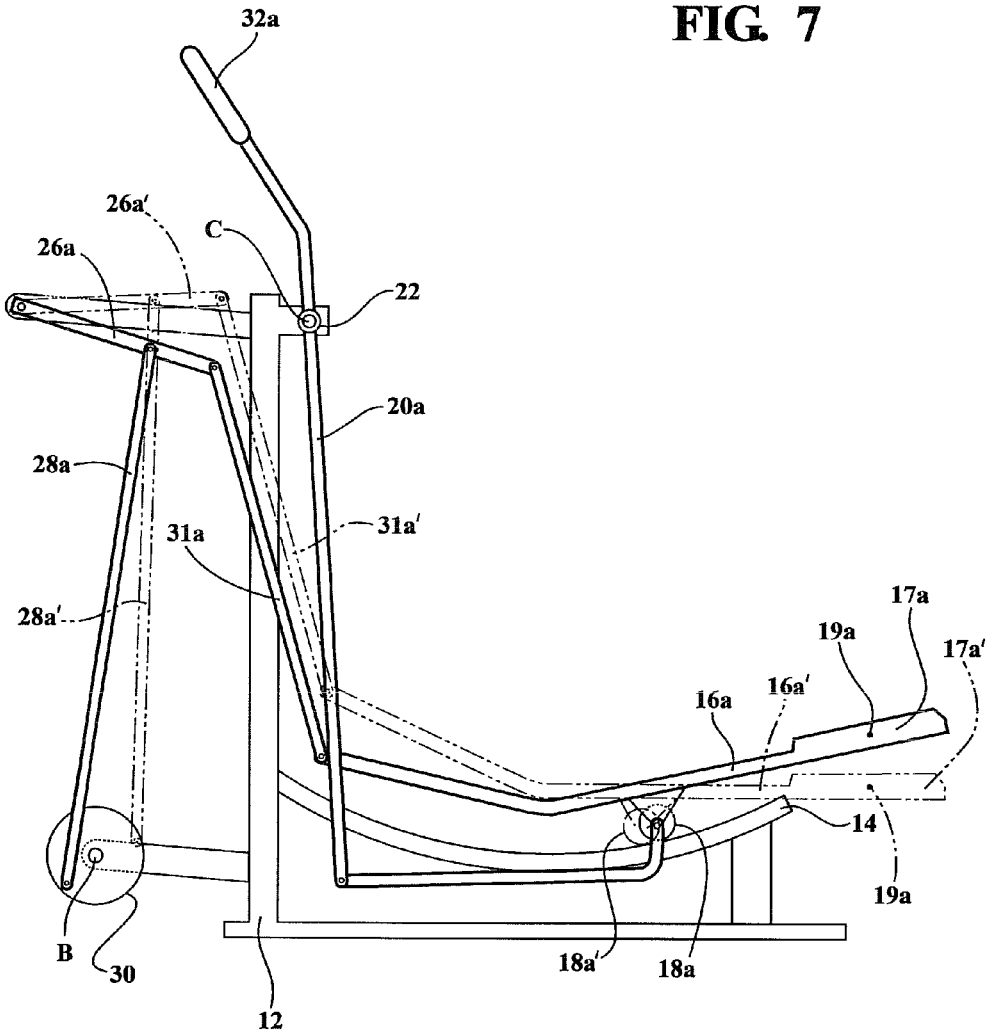
FIG. 7 is a side elevational view of the exercise device of FIG. 1 illustrating the single footpad center point in a third position having a third horizontal location and a third vertical location and a fourth position having the third horizontal location and a fourth vertical location.
Figure 8:
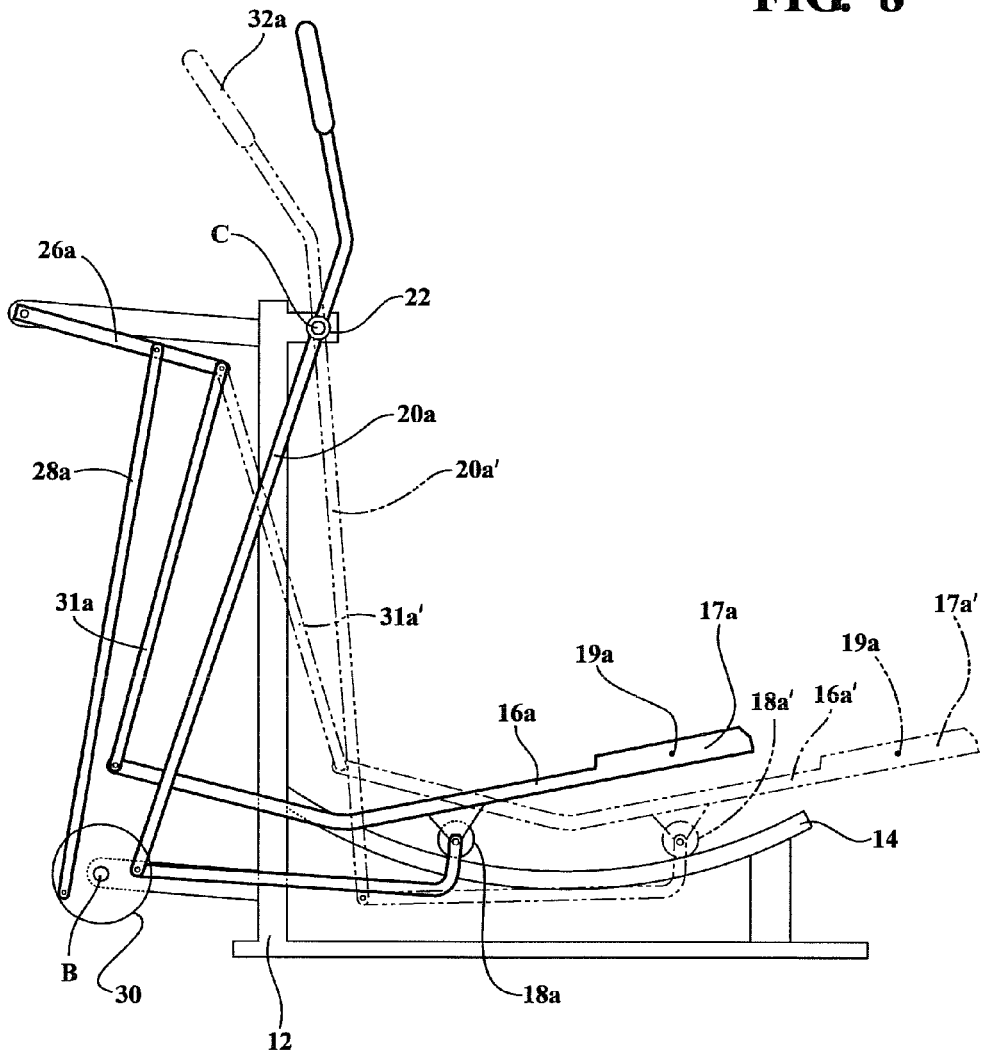
FIG. 8 is a side elevational view of the exercise device of FIG. 1 illustrating the single footpad center point in a fifth position having a fourth horizontal location and a fifth vertical location and a sixth position having a fifth horizontal location and the fifth vertical location.

FIGS. 6-8 illustrate different locations of center point 19*a* of footpad 17*a* when at different positions along different possible paths. FIG. 6 illustrates foot pad center point 19*a* of foot pad 17*a* in a first position having a first horizontal location and a first vertical location and a second position (shown in phantom) having a second horizontal location and a second vertical position. FIG. 7 illustrates the single footpad center point 19*a* in a third position having a third horizontal location and a third vertical location and a fourth position (shown in phantom) having the third horizontal location and a fourth vertical location. FIG. 8 illustrates the single footpad center point 19*a* in a fifth position having a fourth horizontal location and a fifth vertical location and a sixth position (shown in phantom) having a fifth horizontal location and the fifth vertical location. As shown by FIGS. 6-8, the adaptive exercise device allows a single point along a foot link 16*a*, such as a center point 19 of a footpad or a rotational axis of roller 18*a*, to attain different horizontal locations while at the same vertical location and vice-versa. The vertical and horizontal locations are independent of one another.

Although not essential to the present invention, it will be noted that in the FIG. 1 embodiment arm extension portions 32*a*, 32*b* project from respective swing arms 20*a*, 20*b*. These arm extensions 32 are configured to be grasped by a user so as to provide for arm motion during an exercise routine. In this regard, the extension portions 32*a*, 32*b* move about the third pivot point C, and are mechanically coupled to, and will move in unity with, the foot links 16*a*, 16*b*. As noted above, this third pivot point need not coincide with the mechanical coupler 22 as shown in FIGS. 1-3, and may be otherwise located.

Figure 4:
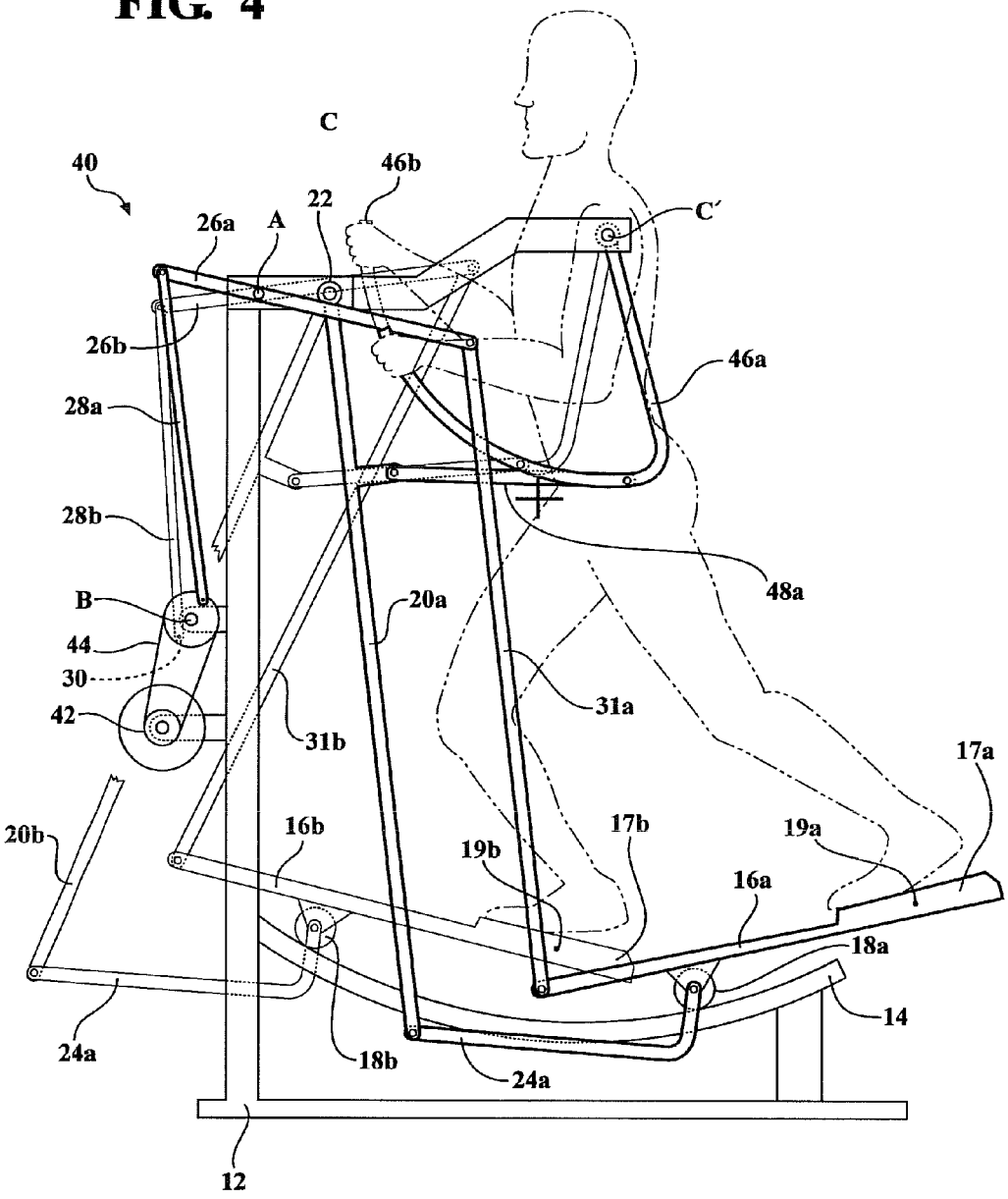
FIG. 4 is a schematic depiction of another embodiment of an exercise device in accord with the present invention, and having arm extensions which differ from those of the FIG. 1 embodiment.

Referring now to FIG. 4, there is shown another embodiment 40 of adaptive exercise device in accord with the present invention. The device 40 of FIG. 4 includes a frame 12, track 14, and foot links 16*a*, 16*b* together with associated rollers 18*a*, 18*b* as generally described above. As further described, the device 40 includes a linkage system which provides for the fore-aft motion of the foot link 16*a*, and this linkage system includes swing arms 20*a*, 20*b* and associated L-shaped members 24*a*, 24*b*. It will be noted that the foot links 16*a*, 16*b* are generally shorter in length than are those of the FIG. 1 embodiment.

In the FIG. 4 embodiment, the vertical motion control system includes vertical control levers 26*a*, 26*b* which are pivotally supported at the first pivot point A at a location between their ends. It will be further be noted that in this embodiment the crank assembly has a flywheel 42 mechanically connected thereto by a drive belt 44 so as to provide increased resistance with regard to vertical motion.

The FIG. 4 embodiment 40 also includes arm extensions which differ in configuration from those of FIG. 1, and are shown as comprising a straight segment having a curved segment joined thereto. In this embodiment, arm extensions 46*a*, 46*b* are pivotally supported on the frame 12 at the third pivot point designated C'. This third pivot point is not coincident with the mechanical coupling 22 as in FIGS. 1-3; but, is located at a separate position on the frame 12. The arm extensions 46 are each mechanically coupled to a respective one of the first and second foot links 16*a*, 16*b* so that when the foot links move in the fore-aft motion along the track, the arm extensions 46 pivot about the third pivot point C'. In this particular instance, such mechanical coupling is achieved by means of a coupling link, for example link 48*a* which joins the arm extension to its respective swing arm 20.

Yet other modifications and variations of this invention may be implemented. As noted above, the various pivot points, including the virtual pivot point X, may be moved so as to make various of them coincident. In a particular instance, the FIG. 4 embodiment may be modified to reposition the vertical control levers so that the first pivot point associated with them is coincident with the third pivot point C'. In other embodiments, flywheels or other variable resistance devices may be associated with the fore-aft motion control systems and/or arm motion system so as to allow for modification of the workout. Also, as will be apparent to those of skill in the art, ancillary equipment such as display devices, speed indicators, distance indicators, and the like may be incorporated into the apparatus. Also, the apparatus may be configured so as to allow for change in the elevation of the track and/or the apparatus itself during the use of the device so as to simulate uphill motion. All of such embodiments are within the scope of the present invention. The foregoing drawings, discussion, and description are illustrative of specific embodiments thereof and are not meant to be limitations upon the practice of the invention. It is the following claims, including all equivalents, which define the scope of the invention.

The invention claimed is:

1. An adaptive exercise device comprising:

a frame configured to be supported on a floor;

at least one track supported on said frame;

a first and a second foot link;

at least one roller associated with each of said foot links, each said at least one roller being disposed so as to engage said at least one track and support its respective foot link thereupon;

a linkage system associated with said first and second foot links, said linkage system being operative to control the motion of said foot links so that when said first foot link moves in a first direction along said at least one track, the second foot link moves in an equal and opposite direction along said at least one track;

a first and a second vertical control link, each vertical control link being pivotally connected to a respective foot link;

a first and a second vertical control lever, each vertical control lever being pivotally supported on said frame at a first pivot point, each vertical control lever being pivotally attached to a respective one of said first and second vertical control links;

a rotary crank which includes at least one crank arm, said crank being pivotally supported on said frame at a second pivot point;

a first and a second connector link, each connector link having a first portion which is pivotally attached to said crank and a second portion which is pivotally attached to a respective one of said first and second vertical control levers so that when said crank rotates about said second pivot point, the first and second vertical control levers each move back and forth in a reciprocating motion, which reciprocating motion is communicated to a respective one of said first and second foot links via the vertical control links.

2. The exercise device of claim 1 further including a first and a second arm extension, each arm extension being pivotally connected to said frame at a third pivot point, each arm extension being mechanically coupled to a respective one of said first and second foot links so that when said foot links move along said at least one track, said arm extensions pivot about said third pivot point.

3. The exercise device of claim 2, wherein each arm extension comprises a projection extending from the linkage system.

4. The exercise device of claim 1, wherein said track is curved.

5. The exercise device of claim 4, wherein said track is curved so as to define a true arc comprising a segment of a circle, said true arc defining a virtual pivot point corresponding to the center of said circle.

6. The exercise device of claim 5, wherein one or more of said first, second, or third pivot points coincide with said virtual pivot point.

7. The exercise device of claim 5, wherein said first and second pivot points coincide with said virtual pivot point.

8. The exercise device of claim 2, wherein one of said first, second and third pivot points is coincident with another of said first, second and third povot points.

9. The exercise device of claim 8, wherein said first pivot point is coincident with said third pivot point.

10. The exercise device of claim 1, further including a variable resistance device which is in mechanical communication with one or more of the first and second vertical control levers, the first and second vertical control links, the rotary crank, the first and second foot links, and the first and second arm extensions.

11. The exercise device of claim 10, wherein said variable resistance device includes a flywheel.

12. An adaptive exercise device comprising:

a frame configured to be supported on a floor;

at least one track supported on said frame;

a rotary crank which includes at least one crank arm, said crank being pivotally supported on said frame;

a first foot link and a second foot link, each of the first foot link and the second foot operably coupled to the rotary crank such that rotation of the rotary crank pivots the first foot link and the second foot link about first and second pivot axes, respectively, that are movable fore and aft along the at least one track;

a linkage system associated with said first and second foot links, said linkage system being operative to control the motion of said foot links so that when said first foot link moves in a first direction along said at least one track, the second foot link moves in an equal and opposite direction along said at least one track;

a first and a second vertical control link, each vertical control link being pivotally connected to a respective foot link;

a first and a second vertical control lever, each vertical control lever being pivotally supported on said frame at a first pivot point, each vertical control lever being pivotally attached to a respective one of said first and second vertical control links; and a first and a second connector link, each connector link having a first portion which is pivotally attached to said crank and a second portion which is pivotally attached to a respective one of said first and second vertical control levers so that when said crank rotates about said second pivot point, the first and second vertical control levers each move back and forth in a reciprocating motion, which reciprocating motion is communicated to a respective one of said first and second foot links via the vertical control links.

13. The exercise device of claim 12 further including a first and a second arm extension, each arm extension being pivotally connected to said frame at a third pivot point, each arm extension being mechanically coupled to a respective one of said first and second foot links so that when said foot links move along said at least one track, said arm extensions pivot about said third pivot point.

14. The exercise device of claim 13, wherein each arm extension comprises a projection extending from the linkage system.

15. The exercise device of claim 12, wherein said track is curved.

16. The exercise device of claim 15, wherein said track is curved so as to define a true arc comprising a segment of a circle, said true arc defining a virtual pivot point corresponding to the center of said circle.

17. The exercise device of claim 16, wherein one or more of said first, second, or third pivot points coincide with said virtual pivot point.

18. The exercise device of claim 16, wherein said first and second pivot points coincide with said virtual pivot point.

19. The exercise device of claim 12, further including a variable resistance device which is in mechanical communication with one or more of the first and second vertical control levers, the first and second vertical control links, the rotary crank, the first and second foot links, and the first and second arm extensions.

20. The exercise device of claim 19, wherein said variable resistance device includes a flywheel.

21. An adaptive exercise device comprising:

a frame configured to be supported on a floor;

at least one track supported on said frame;

a first foot link and a second foot link, each of the first foot link and the second foot being pivotable about an associated pivot axis that is movable fore and aft along the at least one track;

a linkage system associated with said first and second foot links, said linkage system being operative to control the motion of said foot links so that when said first foot link moves in a first direction along said at least one track, the second foot link moves in an equal and opposite direction along said at least one track;

a first and a second vertical control link, each vertical control link being pivotally connected to a respective foot link;

a first and a second vertical control lever, each vertical control lever being pivotally supported on said frame at a first pivot point, each vertical control lever being pivotally attached to a respective one of said first and second vertical control links;

a rotary crank which includes at least one crank arm, said crank being pivotally supported on said frame at a second pivot point;

a first and a second connector link, each connector link having a first portion which is pivotally attached to said crank and a second portion which is pivotally attached to a respective one of said first and second vertical control levers so that when said crank rotates about said second pivot point, the first and second vertical control levers each move back and forth in a reciprocating motion, which reciprocating motion is communicated to a respective one of said first and second foot links via the vertical control links.

22. The exercise device of claim 12, further including a variable resistance device operably coupled to the rotary crank.

* * * * *

UNITED STATES PATENT AND TRADEMARK OFFICE

CERTIFICATE OF CORRECTION

PATENT NO. : 8,740,754 B2
APPLICATION NO. : 12/987223
DATED : June 3, 2014
INVENTOR(S) : Larry D. Miller It is certified that error appears in the above-identified patent and that said Letters Patent is hereby corrected as shown below:

On the Title Page, Item (74), the name of one of the Attorney's listed under the Attorney, Agent, or Firm was misspelled. The correct names under Attorney, Agent, or Firm are Terence P. O'Brien; Todd A. Rathe; Ronald W. Citkowski. Remove the word "Otkowski" and insert the word --Citkowski--. The correct Item (74) reads as follows:

Item (74) Attorney, Agent, or Firm - Terence P. O'Brien; Todd A. Rathe; Ronald W. Citkowski.

Signed and Sealed this
Twenty-second Day of July, 2014

Michelle K. Lee

Michelle K. Lee
*Deputy Director of the United States Patent and Trademark Office*